US009803821B2

(12) United States Patent
Iha et al.

(10) Patent No.: US 9,803,821 B2
(45) Date of Patent: Oct. 31, 2017

(54) VEHICLE-MOUNTED HEADLAMP

(71) Applicant: MITSUBISHI ELECTRIC CORPORATION, Tokyo (JP)

(72) Inventors: Shuichi Iha, Tokyo (JP); Takashi Ohsawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 7 days.

(21) Appl. No.: 15/108,254

(22) PCT Filed: Jan. 17, 2014

(86) PCT No.: PCT/JP2014/050810

§ 371 (c)(1),
(2) Date: Jun. 24, 2016

(87) PCT Pub. No.: WO2015/107678

PCT Pub. Date: Jul. 23, 2015

(65) Prior Publication Data

US 2016/0341386 A1 Nov. 24, 2016

(51) Int. Cl.
*F21S 8/10* (2006.01)
*F21Y 115/10* (2016.01)

(52) U.S. Cl.
CPC ..... *F21S 48/1317* (2013.01); *F21S 48/1104* (2013.01); *F21S 48/1154* (2013.01);
(Continued)

(58) Field of Classification Search
CPC ... B60Q 1/04; F21S 48/10; F21S 48/11; F21S 48/115; F21S 48/1154; F21S 48/1159;
(Continued)

(56) References Cited

U.S. PATENT DOCUMENTS 8,201,981 B2 * 6/2012 Brendle ..... F21S 48/1388 362/514
2003/0147252 A1 8/2003 Fioravanti
(Continued)

FOREIGN PATENT DOCUMENTS

DE 10 2008 056 403 A1 5/2010
DE 10 2009 008 631 A1 8/2010
(Continued)

*Primary Examiner* — Hargobind S Sawhney

(74) *Attorney, Agent, or Firm* — Birch, Stewart, Kolasch & Birch, LLP

(57) ABSTRACT

A vehicle-mounted headlamp using an LED includes a projector lens projecting the LED light to the vehicle front. A light distribution member forming a low-beam lamp light distribution includes: a first incident surface through which the LED light emitted frontward enters; a first reflecting surface disposed on an optical axis such that a projector lens side edge overlaps an LED side focus of the projector lens; a second incident surface and a second reflecting surface disposed on an upper side of the optical axis such that the LED light emitted upward enters through the second incident surface and is reflected frontward by the second reflecting surface; and a third incident surface and a third reflecting surface disposed on the upper side of the optical axis such that the LED light emitted downward enters through the third incident surface and is reflected frontward by the third reflecting surface.

9 Claims, 7 Drawing Sheets

(52) U.S. Cl.
CPC ..... *F21S 48/125* (2013.01); *F21S 48/1216* (2013.01); *F21S 48/1241* (2013.01); *F21S 48/145* (2013.01); *F21S 48/328* (2013.01); *F21Y 2115/10* (2016.08)

(58) Field of Classification Search
CPC ..... F21S 48/1208; F21S 48/1216; F21S 48/1241; F21S 48/125; F21S 48/1266; F21S 48/1291; F21S 48/1317; F21Y 2103/10; G02B 6/0021
See application file for complete search history.

(56) References Cited

U.S. PATENT DOCUMENTS

| | | | |
|---|---|---|---|
| 2010/0046243 | A1 | 2/2010 | Yatsuda |
| 2010/0053987 | A1 | 3/2010 | Nakabayashi |
| 2010/0103694 | A1 | 4/2010 | Saxena et al. |
| 2010/0226142 | A1 | 9/2010 | Brendle et al. |

FOREIGN PATENT DOCUMENTS

| | | | |
|---|---|---|---|
| EP | 2 187 114 | A1 | 5/2010 |
| JP | 2003-260975 | A | 9/2003 |
| JP | 2010-49886 | A | 3/2010 |
| JP | 2010-61902 | A | 3/2010 |
| JP | 2010-73439 | A | 4/2010 |
| JP | 2012-119277 | A | 6/2012 |
| JP | 2013-242996 | A | 12/2013 |

* cited by examiner

VEHICLE-MOUNTED HEADLAMP

TECHNICAL FIELD

The present invention relates to a vehicle-mounted headlamp that uses an LED as a light source and includes a projector lens that projects light emitted by the LED to the front of a vehicle.

BACKGROUND ART

In the present circumstances, where efforts are being undertaken to reduce amounts of discharged carbon dioxide which promotes global warming, and bright LEDs exhibiting high luminous efficiency have come into practical use, LEDs (light emitting diodes, semiconductor light sources) with low power consumption are starting to become more popular in place of conventional tungsten filament light bulbs as light sources of vehicle light fixtures. The LED has a long life and can be controlled simply by supplying a constant current thereto so as to emit a stable brightness, and therefore the LED can be used favorably as a light source of a vehicle light fixture. Moreover, the output (the luminous intensity) of LEDs has increased in recent years, and as a result, LEDs are starting to become more popular as light sources for vehicle-mounted headlamps.

Note that, a vehicle-mounted headlamp, and in particular a low-beam lamp, differs from an usual illumination lamp, a light distribution unique to vehicle-mounted use is required with which drivers of oncoming vehicles are not dazzled, or in other words, with which light is not emitted into the eyes of drivers of oncoming vehicles (i.e. a light distribution with which the positions corresponding to the eyes of drivers of oncoming vehicles become dark).

A conventional example of this type of vehicle-mounted headlamp, in which a low-beam lamp light distribution is formed by providing a light distribution member between an LED and a projector lens and the light emitted by the LED is used effectively, will be described below.

In a vehicle-mounted headlamp according to Patent Document 1, as shown in FIGS. 4 and 9 of Patent Document 1, a low-beam lamp light distribution is formed by a first reflecting surface provided on an optical axis, while light emitted upward by an LED is guided frontward by a second reflecting surface provided above the optical axis, and thereby used effectively.

In this configuration, light emitted downward from the LED is reflected by the first reflecting surface, but the reflected light travels toward the second reflecting surface and is then reflected repeatedly between the two reflecting surfaces so that the light attenuates. Therefore, room for improvement remains with respect to effective use of the light emitted by the LED.

Further, in a configuration shown in FIG. 11 of Patent Document 1, light emitted frontward by the LED enters through an incident surface of an optical member having a function of a convex lens, while the light emitted upward by the LED is guided frontward through being reflected by a convex surface-shaped reflecting surface that forms an inner surface of the incident surface.

In this configuration, the light emitted downward from the LED leaks out, so that room for improvement remains with respect to effective use of the light emitted by the LED.

An optical unit for a vehicle according to Patent Document 2 does not relate to a headlamp, but includes a light incident portion and a reflecting surface for guiding light emitted around from an LED to an exit surface without allowing the light to escape. When this configuration is employed as it is, however, it is impossible to form a light distribution for a headlamp in which a particular light distribution is required.

PRIOR ART DOCUMENTS

Patent Documents

Patent Document 1: Japanese Patent Application Laid-open No. 2010-49886

Patent Document 2: Japanese Patent Application Laid-open No. 2012-119277

SUMMARY OF THE INVENTION

Problem to be Solved by the Invention

In Patent Documents 1 and 2, because configurations as described above are adopted, there is a problem that the light emitted by the LED cannot be used effectively while forming a light distribution for a low-beam lamp.

The present invention has been designed to solve the problem described above, and an object thereof is to provide a vehicle-mounted headlamp in which light emitted by an LED is used effectively while forming a light distribution for a low-beam lamp.

Means for Solving the Problem

A vehicle-mounted headlamp according to the present invention includes an LED having a light emitting surface that is directed to the front of a vehicle, a projector lens that projects light emitted by the LED frontward, and a light distribution member disposed between the LED and the projector lens in order to form a light distribution for a low-beam lamp, wherein the light emitting surface of the LED is disposed on an upper side of an optical axis of the projector lens such that a gap is provided between the light emitting surface and the optical axis, and the light distribution member includes a first incident surface disposed opposing to the LED such that light emitted frontward by the LED enters through the first incident surface, a first reflecting surface disposed on the optical axis such that a projector lens side end edge thereof overlaps an LED side focus position of the projector lens, a second incident surface and a second reflecting surface disposed on the upper side of the optical axis such that light emitted upward by the LED enters through the second incident surface and the light entering through the second incident surface is reflected frontward by the second reflecting surface, and a third incident surface and a third reflecting surface disposed on the upper side of the optical axis such that light emitted downward by the LED enters through the third incident surface and the light entering through the third incident surface is reflected frontward by the third reflecting surface.

Effect of the Invention

According to the present invention, the light distribution member that forms a light distribution for a low-beam lamp includes the second incident surface and the second reflecting surface disposed on the upper side of the optical axis such that the light emitted upward by the LED enters through the second incident surface and the light entering through the second incident surface is reflected frontward by the second reflecting surface, and the third incident surface and the third reflecting surface disposed on the upper side of the optical axis such that the light emitted downward by the LED enters through the third incident surface and the light entering through the third incident surface is reflected frontward by the third reflecting surface. As a result, a vehicle-mounted headlamp that uses the light emitted over a wide range by the LED effectively while forming a light distribution for a low-beam lamp can be provided.

BEST MODES FOR CARRYING OUT THE INVENTION

The present invention will be described in further detail below by explaining embodiments thereof on the basis of the attached drawings.

Embodiment 1

Figure 1:
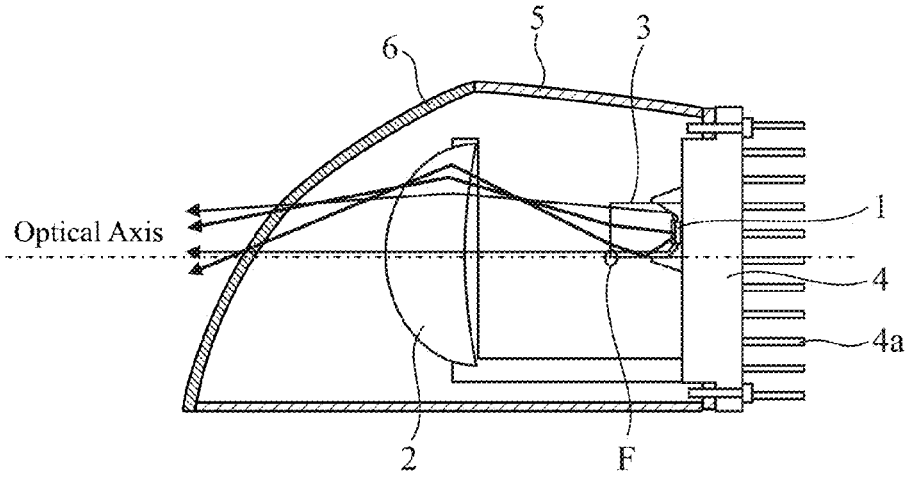
FIG. 1 is a sectional view showing a configuration example of a vehicle-mounted headlamp according to Embodiment 1 of the present invention.

As shown in FIG. 1, a vehicle-mounted headlamp according to Embodiment 1 is an example of a projector type headlamp for use as a low-beam lamp, and includes an LED 1, a projector lens 2 that projects light emitted by the LED 1 to the front of a vehicle, a light distribution member 3 disposed between the LED 1 and the projector lens 2 in order to form a light distribution for a low-beam lamp, a radiator/fixing member 4 that functions as both of a heat sink for dissipating heat generated by the LED 1 and a fixing member for fixing the LED 1, the projector lens 2, and the light distribution member 3, a case 5 housing these components, and a front surface lens 6. Though in the configuration example shown in FIG. 1, a radiator fin 4*a* for dissipating the heat generated by the LED 1 is provided on the radiator/fixing member 4, the radiator fin 4*a* may be exposed to the exterior of the case 5 for improving heat radiation performance.

Figure 2:
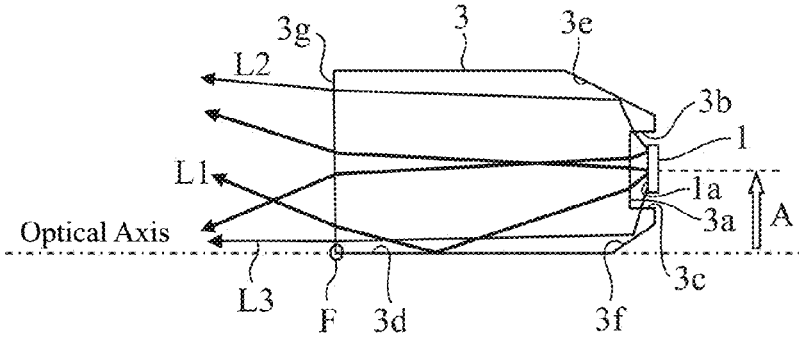
FIG. 2 is a side view showing a configuration of an LED and a light distribution member of the vehicle-mounted headlamp according to Embodiment 1.

FIG. 2 is a side view showing the LED 1 and the light distribution member 3.

The light distribution member 3 is formed of transparent resin, glass, or the like, and is configured such that a first incident surface 3*a* through which light emitted frontward from a light emitting surface 1*a* of the LED 1 enters, a second incident surface 3*b* through which light emitted upward from the light emitting surface 1*a* of the LED 1 enters, and a third incident surface 3*c* through which light emitted downward from the light emitting surface 1*a* of the LED 1 enters are disposed on an upper side of an optical axis. Further, the following surfaces are formed: a first reflecting surface 3*d* disposed on the optical axis such that a projector lens 2 side end edge thereof overlaps an LED 1 side focus position F of the projector lens 2; a second reflecting surface 3*e* that reflects incident light from the second incident surface 3*b* frontward; and a third reflecting surface 3*f* that reflects incident light from the third incident surface 3*c* frontward.

The light that enters the light distribution member 3 and is reflected by the inner surfaces thereof exits through an exit surface 3*g* so as to be inverted vertically and horizontally by the projector lens 2 and projected to the front of the vehicle.

Figure 3:
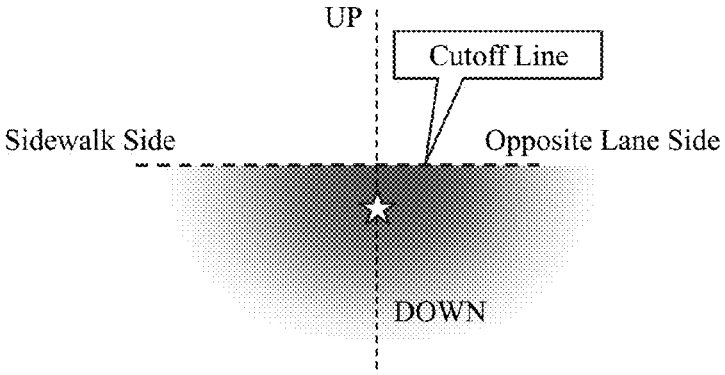
FIG. 3 is a view showing low-beam lamp emitted light emitted to the front of a vehicle from the vehicle-mounted headlamp according to Embodiment 1.

FIG. 3 shows low-beam lamp emitted light emitted to the front of the vehicle from the vehicle-mounted headlamp, wherein parts where the emitted light is bright are densely expressed and parts where the emitted light is dark are sparsely expressed.

In a light distribution for a low-beam lamp, a dark portion must be provided on an upper side of the emitted light to ensure that the driver of an oncoming vehicle is not illuminated, and therefore the upper side must be made dark while the lower side (a road surface side) is made bright. The boundary line between the upper side dark portion and the lower side bright portion of the emitted light is the cutoff line.

In Embodiment 1, light that is emitted downward from the LED 1 and then passes through the projector lens 2 so as to travel above the cutoff line is reflected by the first reflecting surface 3*d* of the light distribution member 3 so as to be guided downward below the cutoff line (light L1 in FIG. 2, for example). As a result, the light emitted to the front of the vehicle from the projector lens 2 is made simultaneously darker on the upper side and brighter on the lower side, whereby a light distribution for a low-beam lamp is formed. Further, the shape of the end edge of the first reflecting surface 3*d* that overlaps the focus position F of the projector lens 2 is projected to the front of the vehicle by the projector lens 2 so as to form the shape of the cutoff line.

Furthermore, by providing the second reflecting surface 3*e* above the second incident surface 3*b* and providing the third reflecting surface 3*f* below the third incident surface 3*c*, light that may leak out in the vertical direction is guided frontward (light L2, L3 in FIG. 2, for example). As a result, the light emitted by the LED 1 can be used effectively.

At this time, for providing the third reflecting surface 3*f* below the third incident surface 3*c*, the light emitting surface of the LED 1 is displaced upward from the optical axis (as represented by the arrow A in FIG. 2). Accordingly, the brightest part, which is indicated by a star mark in FIG. 3, of the low-beam lamp emitted light emitted to the front of the vehicle becomes below the optical axis.

Incidentally, to ensure that the low-beam lamp emitted light is formed in a similar light distribution from a point immediately in front of the vehicle to a far distance, the projector lens 2 side end edge of the light distribution member 3 is disposed to overlap the focus position F of the projector lens 2. However, the end edge does not have to overlap the focus position F precisely, and may be "in the vicinity" thereof.

Here, referring to FIG. 4, an example arrangement of the focus position F of the projector lens 2 will be described. The distance from the LED 1 side surface of the projector lens 2 to the focus position F is represented by D1, and the distance from the focus position F of the projector lens 2 to the projector lens 2 side end edge of the light distribution member 3 is represented by D2.

When "in the vicinity" is used to indicate the positional relationship between the focus position F of the projector lens 2 and the projector lens 2 side end edge of the light distribution member 3, the projector lens 2 side end edge of the light distribution member 3 is disposed within 1/10 of the distance D1 (i.e. such that D2≤D1/10) on either the projector lens 2 side or the LED 1 side of the focus position F of the projector lens 2.

More preferably, the projector lens 2 side end edge of the light distribution member 3 is disposed within 1/20 of the distance D1 (i.e. such that D2≤D1/20) on either the projector lens 2 side or the LED 1 side of the focus position F of the projector lens 2.

Even more preferably, the projector lens 2 side end edge of the light distribution member 3 is disposed within 1/50 of the distance D1 (i.e. such that D2≤D1/50) on either the projector lens 2 side or the LED 1 side of the focus position F of the projector lens 2.

Figure 4:
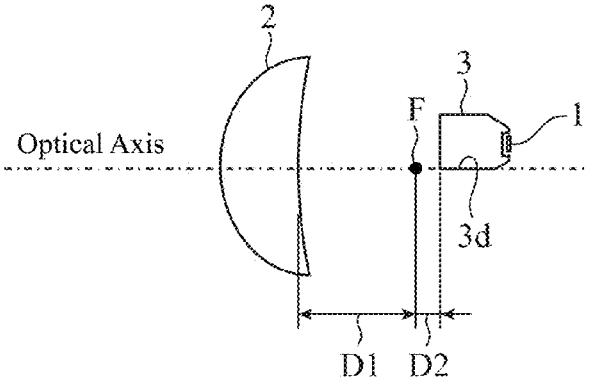
FIG. 4 is a view illustrating an example arrangement of a focus position of a projector lens in the vehicle-mounted headlamp according to Embodiment 1.

However, note that FIG. 4 shows only the distance D2 in a case where the projector lens 2 side end edge of the light distribution member 3 is disposed on the LED 1 side of the focus position F of the projector lens 2, and does not show the distance in a case where the projector lens 2 side end edge of the light distribution member 3 is disposed on the projector lens 2 side.

The distance of the projector lens 2 side end edge of the light distribution member 3 from the focus position F of the projector lens 2 may be determined in accordance with requirements for the light distribution of the emitted light. Incidentally, when the projector lens 2 side end edge of the light distribution member 3, which forms the cutoff line of the low-beam lamp, is disposed closer to the focus position F of the projector lens 2, the cutoff line of the emitted light becomes sharply defined far in front of the vehicle and blurred in locations close to the vehicle. When the projector lens 2 side end edge of the light distribution member 3 is disposed on the LED 1 side at a far position from the focus position F of the projector lens 2, the cutoff line of the emitted light becomes sharply defined in locations close to the vehicle and blurred far in front of the vehicle.

According to Embodiment 1, as described above, the projector type vehicle-mounted headlamp is configured such that the light emitting surface of the LED 1 is disposed on the upper side of the optical axis of the projector lens 2 with a gap from the optical axis (the arrow A in FIG. 2), and the light distribution member 3 includes the first incident surface 3*a* disposed opposing to the LED 1 such that the light emitted frontward by the LED 1 enters through the first incident surface 3*a*, the first reflecting surface 3*d* disposed on the optical axis such that the projector lens 2 side end edge thereof overlaps the LED 1 side focus position F of the projector lens 2, thereby forming a light distribution for a low-beam lamp, the second incident surface 3*b* and the second reflecting surface 3*e*, which are disposed on the upper side of the optical axis such that the light emitted upward by the LED 1 enters through the second incident surface 3*b* and the light entering through the second incident surface 3*b* is reflected frontward by the second reflecting surface 3*e*, and the third incident surface 3*c* and the third reflecting surface 3*f*, which are disposed on the upper side of the optical axis such that the light emitted downward by the LED 1 enters through the third incident surface 3*c* and the light entering through the third incident surface 3*c* is reflected frontward by the third reflecting surface 3*f*. Hence, a vehicle-mounted headlamp in which light emitted over a wide range by an LED is used effectively while forming a light distribution for a low-beam lamp can be provided. As a result, a vehicle-mounted headlamp that is capable of emitting light of sufficient brightness while remaining small in size can be realized. Furthermore, a low-power LED can be used, and therefore the amount of consumption power is small. Accordingly, heat radiation members can be reduced in size, enabling a reduction in the size of the vehicle-mounted headlamp.

Embodiment 2

Figure 5:
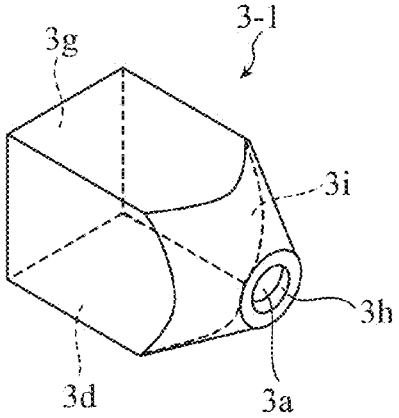
FIG. 5 is a perspective view showing a light distribution member used in a vehicle-mounted headlamp according to Embodiment 2 of the present invention viewed from a first incident surface side.

FIG. 5 is a perspective view showing a configuration of a light distribution member 3-1 used in a vehicle-mounted headlamp according to Embodiment 2. All other configurations of the vehicle-mounted headlamp are similar to those shown in FIGS. 1 to 3.

In Embodiment 2, respective LED side tip end portions of the second incident surface 3*b* and the third incident surface 3*c* of the light distribution member 3-1 form an incident surface 3*h* shaped to surround the light emitting surface 1*a* of the LED 1, not shown in the drawing. As a result, the light emitted from the LED 1 in the horizontal direction can enter the light distribution member 3-1 in addition to the light emitted from the LED 1 in the vertical direction. Accordingly, leakage of the light emitted by the LED 1 over a wide range in the vertical and horizontal directions can be reduced so that the light emitted by the LED 1 can be used efficiently, and as a result, a vehicle-mounted headlamp that emits light of sufficient brightness can be realized even in a small size.

Note that as well as forming the incident surface 3*h* by adding horizontal direction incident surfaces to the vertical direction second and third incident surfaces 3*b*, 3*c* of the LED 1, the inner surfaces of the light distribution member 3-1 may be formed as a reflecting surface 3*i* by adding horizontal direction reflecting surfaces to the vertical direction second and third reflecting surfaces 3*e*, 3*f* such that the light emitted in the horizontal direction is also reflected frontward.

Embodiment 3

Figure 6:
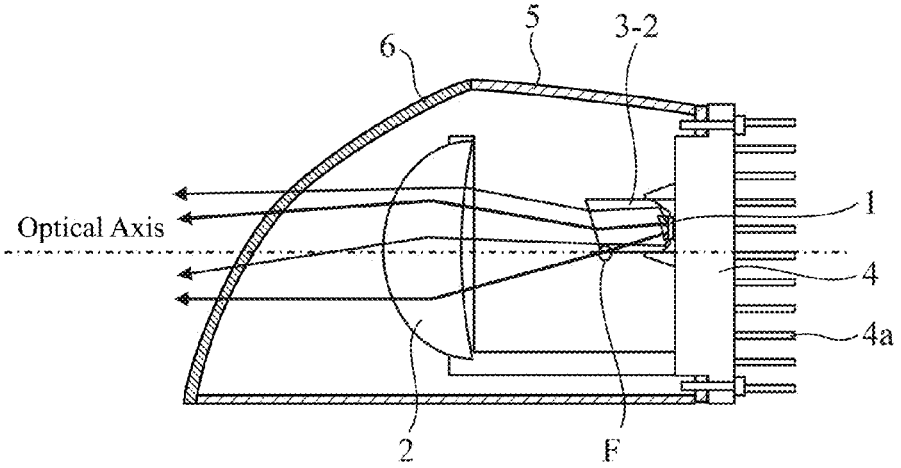
FIG. 6 is a sectional view showing a configuration example of a vehicle-mounted headlamp according to Embodiment 3 of the present invention.
Figure 7:
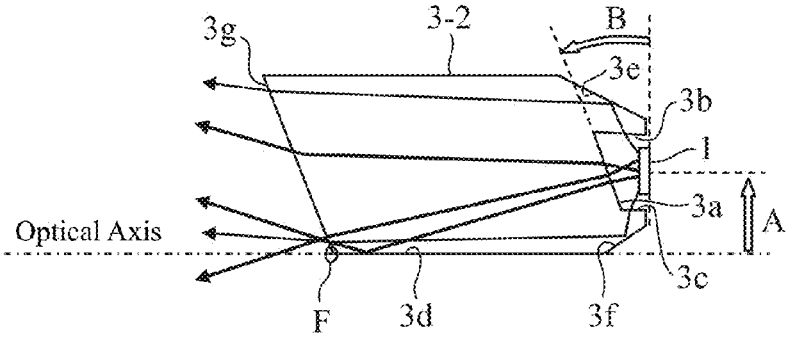
FIG. 7 is a side view showing a configuration of an LED and a light distribution member of the vehicle-mounted headlamp according to Embodiment 3.

FIG. 6 is a sectional view showing a configuration of a vehicle-mounted headlamp according to Embodiment 3, and FIG. 7 is a side view of the LED 1 and a light distribution member 3-2. In FIGS. 6 and 7, parts that are identical or correspond to FIGS. 1 and 2 have been allocated identical reference symbols, and description thereof is omitted.

Figure 8:
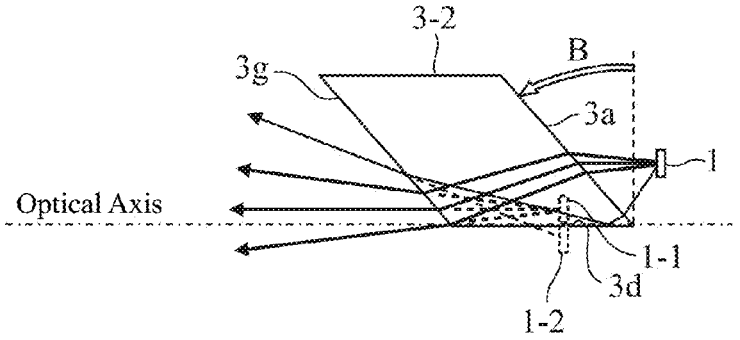
FIG. 8 is a view illustrating a position of a light emitting surface of the vehicle-mounted headlamp according to Embodiment 3.

In Embodiment 3, an upper portion of the first incident surface 3*a* of the light distribution member 3-2 is located closer to the projector lens 2 than a lower portion of the first incident surface 3*a*, or in other words, is inclined frontward (such that a portion far from the optical axis is positioned further frontward) (the arrow B in FIG. 7). Accordingly, as illustrated in FIG. 8, light entering the first incident surface 3*a* is refracted such that a virtual image 1-1 (an apparent light emitting surface) of the LED 1 is formed in the vicinity of the optical axis. Further, the first reflecting surface 3*d* of the light distribution member 3-2 is disposed on the optical axis, and therefore light from the virtual image 1-1 of the LED 1 is reflected so as to form a mirror image 1-2. As a result, upward displacement of the LED 1 (the arrow A in FIG. 7) is canceled out such that an equivalent effect to that obtained by disposing the LED in the vicinity of the optical axis is obtained.

Note that in FIG. 8, the shape of the light distribution member 3-2 is simplified to illustrate the effect obtained by inclining the first incident surface 3*a* of the light distribution member 3-2 frontward.

Figure 9:
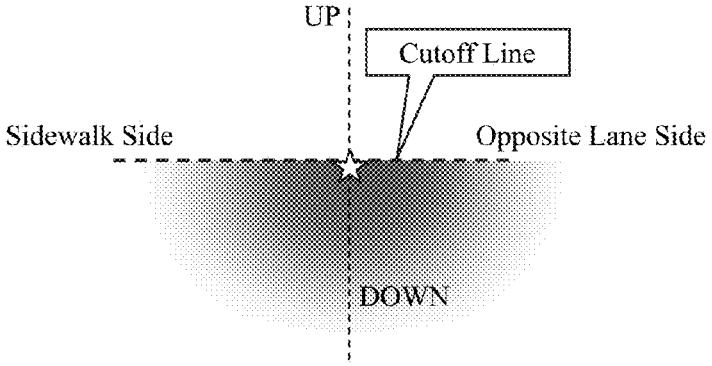
FIG. 9 is a view showing low-beam lamp emitted light emitted to the front of the vehicle from the vehicle-mounted headlamp according to Embodiment 3.

FIG. 9 shows a low-beam lamp emitted light emitted to the front of the vehicle from the vehicle-mounted headlamp, wherein parts where the emitted light is bright are densely expressed and parts where the emitted light is dark are sparsely expressed. In Embodiment 3, the virtual image 1-1 and the mirror image 1-2 of the LED 1 are formed in the vicinity of the optical axis in accordance with the shape of the light distribution member 3-2, and therefore the brightest location indicated by the star mark is just below the cutoff line emitted to the front of the vehicle.

By increasing the brightness in the location just below the cutoff line, or in other words the location that extends into far distance as in the light distribution shown in FIG. 9, favorable visibility is obtained in front of the vehicle, and therefore this light distribution can be used favorably in a headlamp.

Note that when the gap between the light emitting surface of the LED 1 and the optical axis is wide, the lower end edge of the apparent light emitting surface of the LED 1 may be brought closer to the optical axis by either increasing the incline of the first incident surface 3*a* of the light distribution member 3-2 or increasing the optical axis direction thickness of the light distribution member 3-2 (i.e. increasing the distance over which light passes) such that the light emitted by the LED 1 is refracted to the optical axis side.

Figure 14:
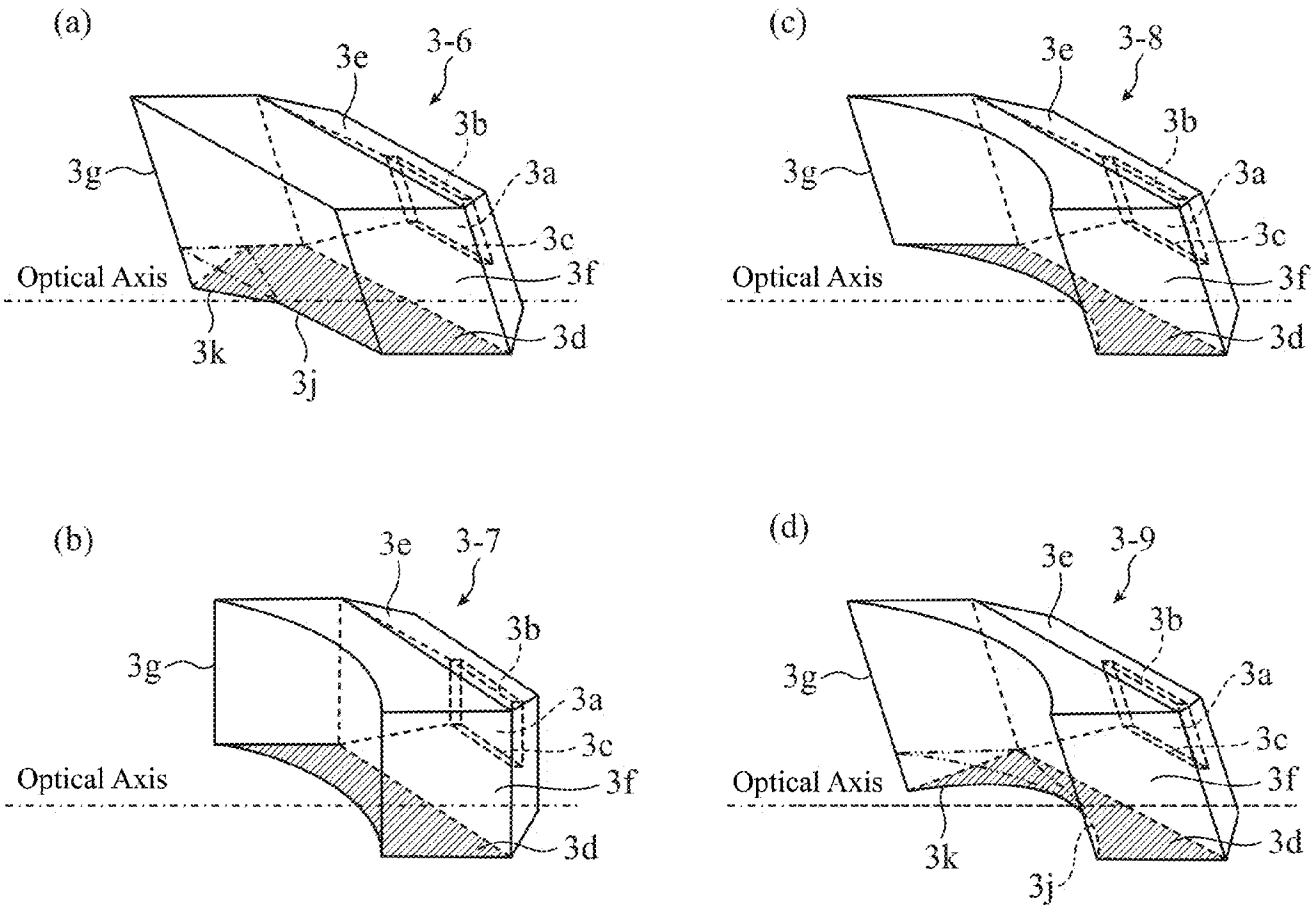
FIGS. 14(*a*) to 14(*d*) show perspective views showing some examples of the light distribution member used in the vehicle-mounted headlamp according to Embodiment 5.

Further, the exit surface 3*g* of the light distribution member 3-2 is not limited to the frontward inclined shape such as shown in FIG. 7, and the light distribution shape may be adjusted by forming the exit surface 3*g* in the vertical shape such as shown in FIG. 2, a convex lens shape that bulges out toward the center of the surface, or a concave lens shape that recedes toward the center of the surface (for example, the shape of the exit surface 3*g* shown in FIG. 14(*b*), to be described below).

According to the third embodiment, as described above, the light distribution member 3-2 is configured such that the upper portion of the first incident surface 3*a* is closer to the projector lens 2 than the lower portion of the first incident surface 3*a*, or in other words such that the first incident surface 3*a* inclines frontward (such that the portion far from the optical axis is positioned further frontward), and therefore the light emitted by the LED 1 can be refracted to the optical axis side such that the lower end edge of the apparent light emitting surface of the LED approaches the optical axis. Accordingly, a favorable light distribution with which bright light can be emitted into far distance is not impaired even when a gap is provided between the light emitting surface of the LED 1 and the optical axis for providing the third incident surface 3*c* below the LED 1.

Embodiment 4

Figure 10:
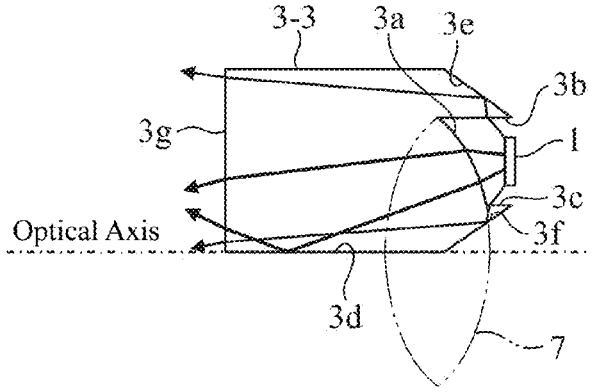
FIG. 10 is a side view illustrating a configuration example of a light distribution member used in a vehicle-mounted headlamp according to Embodiment 4 of the present invention.
Figure 11:
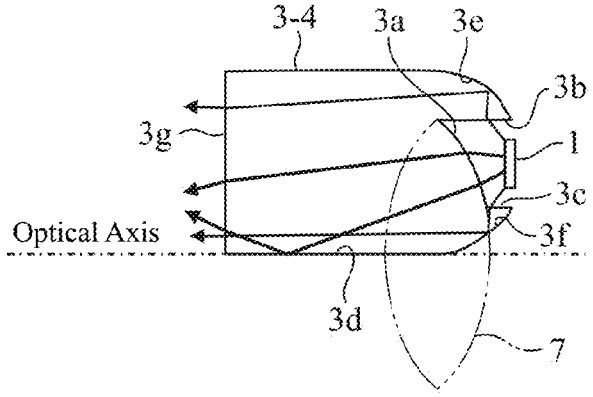
FIG. 11 is a side view illustrating another configuration example of the light distribution member used in the vehicle-mounted headlamp according to Embodiment 4.

FIGS. 10 and 11 are side views respectively showing light distribution members 3-3, 3-4 used in a vehicle-mounted headlamp according to Embodiment 4. All other configurations of the vehicle-mounted headlamp are similar to those shown in FIGS. 1 to 9.

In the examples shown in FIGS. 10 and 11, the respective first incident surfaces 3*a* of the light distribution members 3-3, 3-4 have a surface shape that forms a part of a convex lens 7 that is convex toward the LED 1 side. Accordingly, the light emitted by the LED 1 can be condensed by the convex lens surface of the first incident surface 3*a*, and as a result, a vehicle-mounted headlamp having a favorable light distribution can be realized.

Note that by forming the first incident surface 3*a* to be the shape of the convex lens 7 in an upper side of the optical axis of the convex lens 7, a similar effect to that obtained by inclining the first incident surface 3*a* frontward (so that the upper portion is closer to the projector lens 2 than the lower portion) is obtained.

Further, in the example shown in FIG. 11, the second reflecting surface 3*e* and the third reflecting surface 3*f* of the light distribution member 3-4 are formed as concave surfaces. Note that with this shape, the concave surfaces are formed on the inner surfaces of the light distribution member 3-4 that serve as reflecting surfaces, and therefore the reflecting surfaces appear as convex surfaces when seen from the outside.

By forming the reflecting surfaces as concave surfaces as shown in FIG. 11, the light emitted by the LED 1 can be condensed, and as a result, a vehicle-mounted headlamp having a favorable light distribution can be realized.

Embodiment 5

Figure 12:
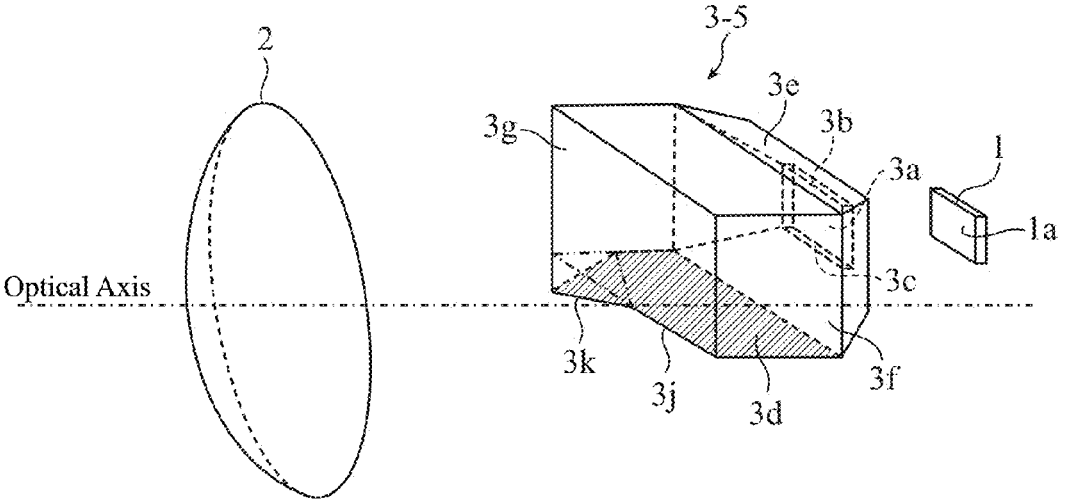
FIG. 12 is a perspective view showing a light distribution member used in a vehicle-mounted headlamp according to Embodiment 5 of the present invention viewed from an exit surface side.

FIG. 12 is a perspective view showing a light distribution member 3-5 used in a vehicle-mounted headlamp according to Embodiment 5 from the exit surface 3*g* side. All other configurations of the vehicle-mounted headlamp are similar to those shown in FIGS. 1 to 11.

In the example shown in FIG. 12, the projector lens 2 side end edge of the first reflecting surface 3*d* (a shaded region) of the light distribution member 3-5 is configured such that a left side (a sidewalk side) thereof in the frontward direction of the vehicle is formed to be horizontal, thereby forming a horizontal portion 3*j*, and a right side (an opposing lane side) is inclined downward, thereby forming an inclined portion 3*k*.

Figure 13:
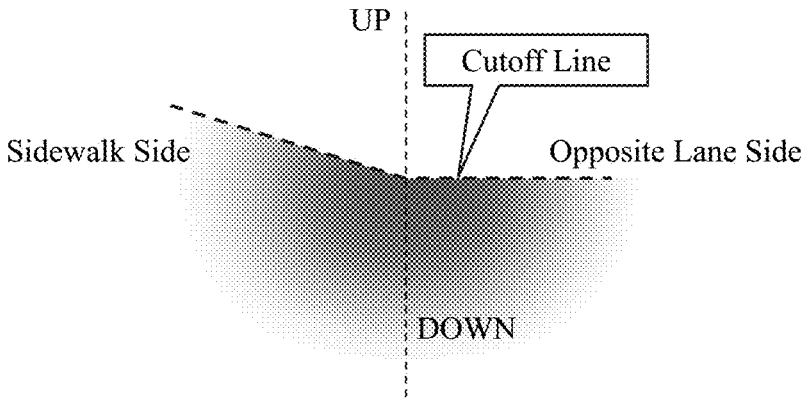
FIG. 13 is a view showing low-beam lamp emitted light emitted to the front of the vehicle from the vehicle-mounted headlamp according to Embodiment 5.

FIG. 13 shows low-beam lamp emitted light emitted to the front of the vehicle from the vehicle-mounted headlamp, wherein parts where the emitted light is bright are densely expressed and parts where the emitted light is dark are sparsely expressed.

As shown in FIG. 13, when a shadow of the emitted light formed by the end edge shapes of the horizontal portion 3*j* and the inclined portion 3*k* of the light distribution member 3-5 shown in FIG. 12 is inverted vertically and horizontally by the projector lens 2 and projected to the front of the vehicle, a low-beam lamp light distribution with which the left side (the sidewalk side) can be illuminated up to a high position while keeping the cutoff line on the right side (the opposing lane side) horizontal can be formed.

As a matter of course, in a left-hand drive headlamp, the shapes of the projector lens 2 side end edges of the light distribution member 3-5 are left-right reversed so that the horizontal portion 3*j* and the inclined portion 3*k* are formed respectively on the right side (the sidewalk side) and the left side (the opposing lane side) in the frontward direction of the vehicle.

Note that as long as a planar surface that serves as the first reflecting surface 3*d* can be formed on the optical axis side, the light distribution member 3-5 may take a shape other than that shown in FIG. 12. FIGS. 14(*a*) to 14(*d*) show modified examples of the light distribution member 3-5.

A light distribution member 3-6 shown in FIG. 14(*a*) is shaped such that the exit surface 3*g* is inclined frontward (i.e. such that the portion far from the optical axis is positioned further frontward). By forming the horizontal portion 3*j* and the inclined portion 3*k* on the projector lens 2 side end edges of the first reflecting surface 3*d* in this light distribution member 3-6, a cutoff line such as shown in FIG. 13 is obtained.

A light distribution member 3-7 shown in FIG. 14(*b*) is configured such that the exit surface 3*g* takes a curved surface shape and the projector lens 2 side end edges of the first reflecting surface 3*d* are arc-shaped. When, due to aberration in the projector lens 2, a line (a group of linear focal points) corresponding to a focal point at which light passing through the projector lens 2 becomes parallel light takes an arc shape rather than forming a straight line that is orthogonal to the optical axis, the light distribution member 3-7, in which the end edges are formed in the same arc shape, is used. A shadow is formed on the emitted light by the arc-shaped end edges, and therefore a vertical contrast required for a low-beam lamp, in which the cutoff line is sharply defined over a wide horizontal direction range from the center of the vehicle, can be formed.

A light distribution member 3-8 shown in FIG. 14(*c*) is obtained by forming the exit surface 3*g* of the light distribution member 3-7 shown in FIG. 14(*b*) in a frontward inclined shape, similarly to FIG. 14(*a*).

A light distribution member 3-9 shown in FIG. 14(*d*) is obtained by forming the horizontal portion 3*j* and the inclined portion 3*k* on the projector lens 2 side end edges of the light distribution member 3-8 shown in FIG. 14(*c*).

Note that FIG. 12 and FIGS. 14(*a*) to 14(*d*) show examples of shapes obtained by modifying the light distribution member 3 of Embodiment 1, described above, but the shape of the light distribution member is not limited to these examples. Further, similar modifications may be applied to the respective light distribution members of Embodiments 2 to 4 and so on.

According to Embodiment 5, as described above, the projector lens 2 side end edges of the first reflecting surface 3*d* of the light distribution member 3-5 are configured such that the horizontal portion 3*j* is formed on the sidewalk side and the inclined portion 3*k* that inclines downward is formed on the opposing lane side. Accordingly, the cutoff line on the opposing lane side can be made horizontal so as not to illuminate drivers of oncoming vehicles, while the cutoff line on the sidewalk side can be raised so that pedestrians on the sidewalk can be illuminated. As a result, a vehicle-mounted headlamp having a favorable light distribution can be realized.

Embodiment 6

In Embodiment 6, several examples of the projector lens used in the vehicle-mounted headlamp will be described.

Figure 15:
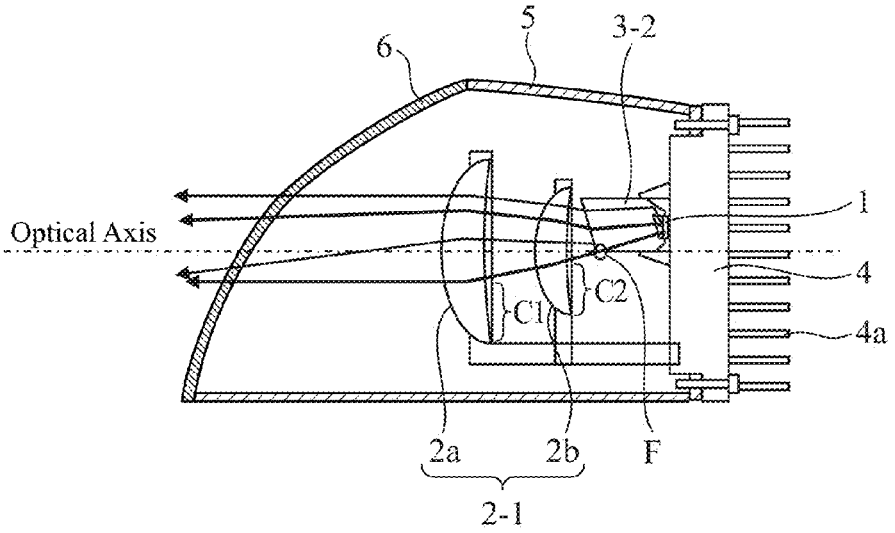
FIG. 15 is a sectional view showing a configuration example of a vehicle-mounted headlamp according to Embodiment 6 of the present invention.

FIG. 15 is a sectional view showing a configuration of a vehicle-mounted headlamp according to Embodiment 6. In FIG. 15, parts that are identical or correspond to FIG. 6 have been allocated identical reference symbols, and description thereof is omitted.

In Embodiment 6, a projector lens set 2-1 is formed from an emission side convex lens 2*a* and an LED side convex lens 2*b*, which are disposed so as to overlap in the optical axis direction. By combining a plurality of projector lenses, the projector lens 2-1 can be configured to have a short focal length using the convex lenses 2*a*, 2*b*, which have realistic thicknesses. By adopting a projector lens having a short focal length, a favorably shaped vehicle-mounted headlamp having a small aperture and a short depth can be realized.

Further, by controlling the respective lens shapes and refraction amounts of the convex lenses 2*a*, 2*b*, an even more favorable vehicle-mounted headlamp can be realized. The lens shape and the refraction amount will be described below with reference to FIG. 15 and FIG. 17, respectively.

As shown in FIG. 15, the projector lens 2-1 includes portions C1, C2 which are located below the optical axis thereof, which do not receive the light emitted by the LED 1 since the light is interrupted by the first reflecting surface 3*d* of the light distribution member 3-2. These portions C1, C2 of the convex lenses 2*a*, 2*b* that do not receive light serve no purpose and may therefore be omitted without affecting the brightness and the light distribution. Hence, the portions C1, C2 that do not receive light may be omitted.

Figure 16:
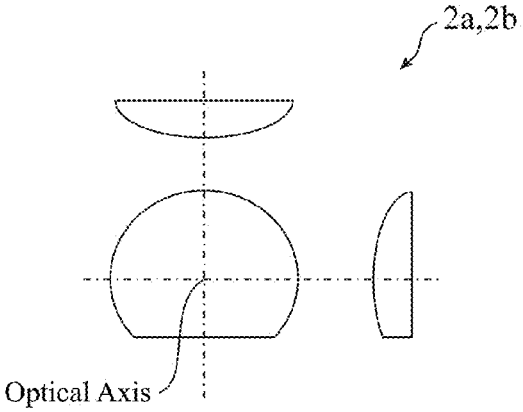
FIG. 16 is a three-sided orthographic views showing an example of a projector lens used in the vehicle-mounted headlamp according to Embodiment 6.

Here, FIG. 16 shows a shape in which the portions C1, C2 (in other words, the parts on the lower side of the optical axis) that do not receive light are omitted from the convex lenses 2*a*, 2*b* so that the lower side of the optical axis is reduced in size in comparison with the upper side of the optical axis. By using the convex lenses 2*a*, 2*b* as the projector lens set 2-1, the vehicle-mounted headlamp can be reduced in size in the vertical direction.

As a matter of course, the parts on the lower side of the optical axis that do not receive light may also be omitted from the projector lenses 2 according to Embodiments 1 to 5 so that the lower side of the optical axis is reduced in size in comparison with the upper side of the optical axis.

In the projector lens, contrast is generated on the upper and lower sides of the cutoff line by vertical direction refraction, and a light distribution in which the light emitted from the headlamp spreads out in the horizontal direction is generated by horizontal refraction.

Figure 17:
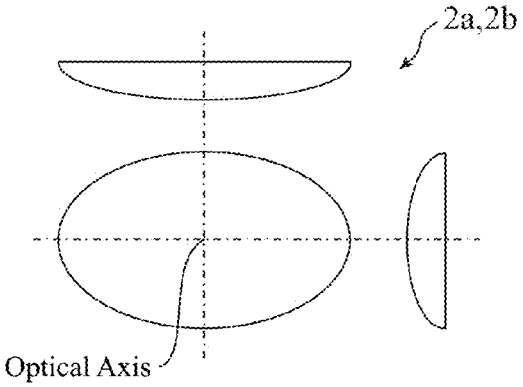
FIG. 17 is a three-sided orthographic views showing another example of the projector lens used in the vehicle-mounted headlamp according to Embodiment 6.

By forming the projector lens using elliptical convex lenses 2*a*, 2*b*, which have different refraction amounts (lens surface curvatures) between the vertical and horizontal directions, as shown in FIG. 17, for example, a wide horizontal direction range can be brightened while maintaining the brightness of a central portion.

Note that, in FIG. 17, an elliptical convex lens being a type of aspherical lens is shown. Although a full elliptical shape is shown only to illustrate the difference in curvature between the vertical direction and the horizontal direction on the lens surface, it is possible to omit unnecessary parts as shown in FIG. 16, and the lens may be formed to be a square outer shape or the like instead, for example. Further, a convex lens in which the vertical direction curvature and the horizontal direction curvature of the lens surface are different may also be used as the projector lens 2 according to Embodiments 1 to 5.

By employing the elliptical convex lenses 2*a*, 2*b*, or in other words convex lenses in which the vertical direction curvature of the lens surface is larger than the horizontal direction curvature, light can be emitted over a wide range in the horizontal direction while maintaining the frontward brightness and the shape of the cutoff line. As a result, a favorable headlamp light distribution enabling illumination of pedestrians on a far edge of a sidewalk, a shoulder of the oncoming lane, and so on can be formed.

According to Embodiment 6, as described above, the projector lens 2-1 is constituted by the plurality of convex lenses 2*a*, 2*b* disposed so as to overlap in the optical axis direction, and therefore the focal length of the projector lens is shortened such that a favorably shaped vehicle-mounted headlamp having a small aperture and a short depth can be realized. Further, by controlling the shapes and refraction amounts of the respective lenses, even more favorable vehicle-mounted headlamp can be realized.

Furthermore, according to Embodiment 6, by adopting the convex lenses 2*a*, 2*b* respectively having different sizes on the upper side and lower side of the optical axis as the projector lens 2-1, a small vehicle-mounted headlamp can be realized.

Moreover, according to Embodiment 6, by employing the convex lenses 2*a*, 2*b* configured such that the vertical direction curvature of the lens surface differs from the horizontal direction curvature as the projector lens 2-1, a vehicle-mounted headlamp having an even more favorable light distribution can be realized.

Note that in Embodiments 1 to 6, examples in which an LED (a light emitting diode, a semiconductor light source) that emits visible light is used as the light source of the vehicle-mounted headlamp were described, but a light source formed from a combination of an LED that emits a specific type of light such as laser light and a wavelength conversion element (a fluorescent material) may be used instead.

Other than the configurations described above, the embodiments may be combined freely within the scope of the present invention. Further, any of the constituent elements of the respective embodiments may be modified, and any of the constituent elements may be omitted from the respective embodiments.

INDUSTRIAL APPLICABILITY

As described above, the vehicle-mounted headlamp according to the present invention is configured using a light distribution member so that light emitted by an LED is emitted efficiently to the front of a vehicle. Accordingly, the vehicle-mounted headlamp according to the present invention is suitable for use as a low-beam headlamp or the like.

EXPLANATION OF REFERENCE NUMERALS

1: LED
1*a*: light emitting surface
1-1: virtual image
1-2: mirror image
2, 2-1: projector lens
2*a*, 2*b*, 7: convex lens
3, 3-1 to 3-9: light distribution member
3*a*: first incident surface
3*b*: second incident surface
3*c*: third incident surface
3*d*: first reflecting surface
3*e*: second reflecting surface
3*f*: third reflecting surface
3*g*: exit surface
3*h*: incident surface
3*i*: reflecting surface
3*j*: horizontal portion
3*k*: inclined portion
4: radiator/fixing member
4*a*: radiator fin
5: case
6: front surface lens
F: LED side focus position of projector lens

The invention claimed is:

1. A vehicle-mounted headlamp of a projector type, comprising:

an LED having a light emitting surface that is directed to a front of a vehicle;

a projector lens that projects light emitted by the LED frontward; and a light distribution member disposed between the LED and the projector lens to form a light distribution for a low-beam lamp, wherein the light emitting surface of the LED is disposed on an upper side of an optical axis of the projector lens such that a gap is provided between the light emitting surface and the optical axis, and the light distribution member includes:

a first incident surface disposed opposing to the LED such that light emitted frontward by the LED enters through the first incident surface;

a first reflecting surface disposed on the optical axis such that an end edge of a side of the projector lens thereof overlaps a focus position of the projector lens of a side of the LED;

a second incident surface and a second reflecting surface which are disposed on the upper side of the optical axis such that a light emitted upward by the LED enters through the second incident surface and the light entering through the second incident surface is reflected frontward by the second reflecting surface; and a third incident surface and a third reflecting surface disposed on the upper side of the optical axis such that a light emitted downward by the LED enters through the third incident surface and the light entering through the third incident surface is reflected frontward by the third reflecting surface.

2. The vehicle-mounted headlamp according to claim 1, wherein respective tip end portions of the second incident surface and the third incident surface of the light distribution member of the side of the LED are shaped to surround the light emitting surface of the LED.

3. The vehicle-mounted headlamp according to claim 1, wherein the first incident surface of the light distribution member is configured such that an upper portion thereof is closer to the projector lens than a lower portion thereof.

4. The vehicle-mounted headlamp according to claim 1, wherein the first incident surface of the light distribution member forms a part of a convex lens surface that is convex toward the LED side, and an upper portion of the first incident surface is closer to the projector lens than a lower portion of the first incident surface.

5. The vehicle-mounted headlamp according to claim 1, wherein the second reflecting surface and the third reflecting surface of the light distribution member are respectively planar surfaces or concave surfaces.

6. The vehicle-mounted headlamp according to claim 1, wherein the end edge of the first reflecting surface of the light distribution member of the side of the projector lens is configured to be horizontal on a sidewalk side and inclined downward on an oncoming lane side.

7. The vehicle-mounted headlamp according to claim 1, wherein the projector lens is constituted by a plurality of lenses disposed so as to overlap in a direction of the optical axis.

8. The vehicle-mounted headlamp according to claim 1, wherein the projector lens has different sizes between the upper side and a lower side of the optical axis.

9. The vehicle-mounted headlamp according to claim 1, wherein a lens surface of the projector lens has different curvatures between a vertical direction and a horizontal direction.

* * * * *